US006860697B2

(12) United States Patent
Bradbury et al.

(10) Patent No.: US 6,860,697 B2
(45) Date of Patent: Mar. 1, 2005

(54) CONTAINER UNLOADING APPARATUS

(75) Inventors: Robert Mann Bradbury, Powhatan, VA (US); William Albert Cupp, Aylett, VA (US); Michael Kent, Aylesbury (GB); Paul Malcolm Meade, Richmond, VA (US); Dirk Pruessmann, Glen Allen, VA (US); William Joseph Schreier, Jr., Richmond, VA (US); Philip Neil Theurer, Glen Allen, VA (US); Clive William Watson, Croizer, VA (US)

(73) Assignee: Molins Plc, Milton Keynes (GB)

( * ) Notice: Subject to any disclaimer, the term of this patent is extended or adjusted under 35 U.S.C. 154(b) by 0 days.

(21) Appl. No.: 09/825,944

(22) Filed: Apr. 5, 2001

(65) Prior Publication Data

US 2002/0041802 A1 Apr. 11, 2002

Related U.S. Application Data

(63) Continuation of application No. PCT/GB99/03285, filed on Oct. 5, 1999.

(30) Foreign Application Priority Data

Oct. 5, 1998 (GB) ..... 98 21665

(51) Int. Cl.[7] ..... B65G 65/23

(52) U.S. Cl. ..... 414/420; 414/414; 414/421; 198/347.1; 131/909

(58) Field of Search ..... 414/414, 420, 414/421; 198/347.1, 347.2; 131/282, 283, 909

(56) References Cited

U.S. PATENT DOCUMENTS

| | | | | |
|---|---|---|---|---|
| 3,190,478 A | | 6/1965 | Schmermnd | 214/307 |
| 3,305,128 A | * | 2/1967 | Dearsley | 221/9 |
| 3,717,270 A | * | 2/1973 | Rooke et al. | 414/414 |
| 3,854,611 A | * | 12/1974 | Wahle | 414/414 |
| 3,985,252 A | * | 10/1976 | Hinchcliffe et al. | 414/403 |
| 4,042,094 A | * | 8/1977 | Schmermund | 198/347.1 |
| 4,303,366 A | | 12/1981 | Hinchcliffe et al. | 414/419 |
| 4,361,759 A | * | 11/1982 | King et al. | 250/223 R |
| 4,365,703 A | * | 12/1982 | Hinchcliffe et al. | 414/413 |
| 4,366,895 A | * | 1/1983 | Bennett et al. | 414/421 |
| 4,420,073 A | * | 12/1983 | Hausler et al. | 198/347.2 |
| 4,449,625 A | * | 5/1984 | Grieben et al. | 198/465.1 |

(List continued on next page.)

FOREIGN PATENT DOCUMENTS

| | | | |
|---|---|---|---|
| DE | 3338390 | 4/1984 | A24C/5/356 |
| EP | 0334115 | 1/1994 | A24C/5/356 |
| FR | 1548260 | 10/1968 | |
| FR | 2226124 | 11/1974 | A24C/5/35 |
| FR | 2372757 | 6/1978 | B65G/65/02 |
| GB | 2097353 | * 11/1982 | |
| GB | 2196928 | * 5/1988 | |

*Primary Examiner*—James W. Keenan
(74) *Attorney, Agent, or Firm*—Antonelli, Terry, Stout & Kraus, LLP

(57) ABSTRACT

A tray unloader for rod-like articles of the tobacco industry includes a horizontally-movable, slidable carriage supporting an independently-driven tray inverting carrier arranged to pick up an upright full tray from a receiving position and invert it during movement to an unloading position. In the unloading position articles are received directly over opposed horizontal bands having a delivery channel between confronting ends and defining the initial level at which articles are received over most of the width of the tray. Downstream of the channel is a conveyor which operates at a relatively high rate during a first phase of unloading for each tray and at a reduced rate during a second phase, so as to allow controlled emptying of the tray and establishment of the residual level of articles in the channel after completion of unloading of each tray.

29 Claims, 6 Drawing Sheets

U.S. PATENT DOCUMENTS

RE31,777 E * 12/1984 Carascon et al. ..... 406/28
4,575,301 A 3/1986 Lodi et al. ..... 414/411
4,580,939 A * 4/1986 Dyett et al. ..... 414/198
4,690,604 A * 9/1987 Calverley et al. ..... 414/403
4,717,009 A * 1/1988 Carter et al. ..... 198/347.1
4,744,453 A * 5/1988 Krause et al. ..... 198/347.2
4,790,333 A * 12/1988 Focke et al. ..... 131/283
4,830,176 A * 5/1989 Hierons ..... 198/502.2
4,865,179 A * 9/1989 Carter et al. ..... 198/347.2
4,962,840 A * 10/1990 Miura et al. ..... 198/347.1
5,103,960 A * 4/1992 Brown et al. ..... 198/347.1
5,568,856 A * 10/1996 Colley et al. ..... 198/347.2
5,845,758 A * 12/1998 Bryant et al. ..... 198/347.3

* cited by examiner

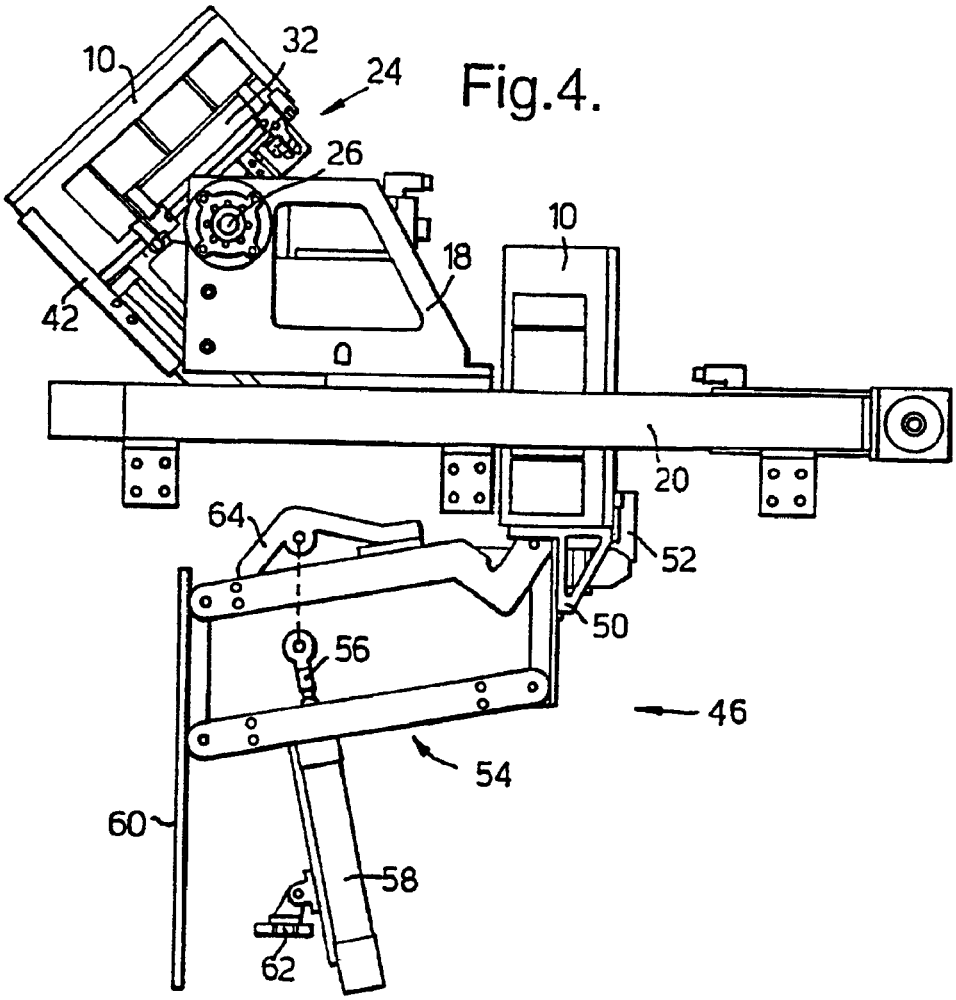
Fig.4.
Fig.7.
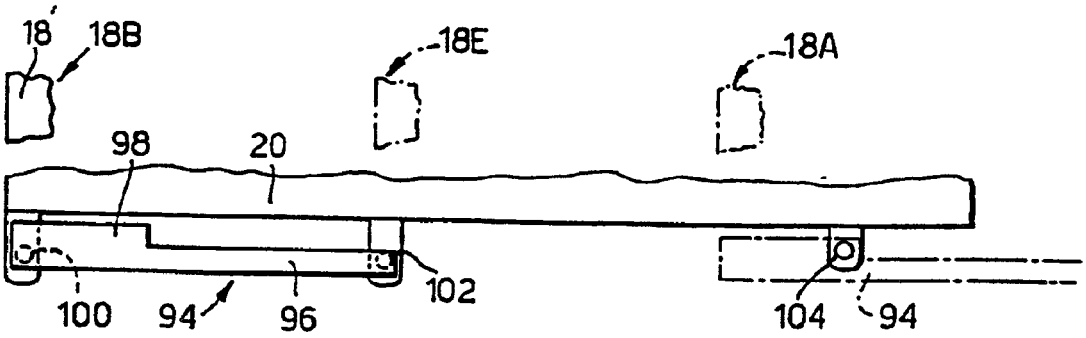

CONTAINER UNLOADING APPARATUS

This application is a continuation of PCT/GB99/03285, filed Oct. 5, 1999.

BACKGROUND OF THE INVENTION

This invention relates to container unloading apparatus, particularly apparatus for unloading containers of rod-like articles such as cigarettes or cigarette filter rods.

In the cigarette industry it is known to transport cigarettes and cigarette filter rods in trays, each of which typically contains 4,000 articles, at least partly between a producing machine, such as a cigarette or filter rod making machine, and a receiving machine, such as a cigarette packing machine or a filter rod assembling machine. In the case of cigarettes containers may be unloaded at the packing machine, or upstream of it for conveyance to the packing machine in a multi-layer stream of articles. In the case of filter rods, although the containers may similarly be unloaded at the filter rod assembling machine, it is common to unload them at or upstream of a pneumatic filter rod distributor unit, from which filter rods are pneumatically conveyed to the filter rod assembling machine. Again, the filter rods may be conveyed in a multi-layer stream of articles subsequent to unloading. The present invention is particularly, but not exclusively, concerned with apparatus suitable for unloading trays in any of these situations.

BRIEF SUMMARY OF THE INVENTION

According to a first aspect of the invention apparatus for unloading containers for rod-like articles comprises a carrier for receiving a full container in a receiving position in a first orientation, and means for moving the carrier to an unloading position at which the carrier is in a second orientation, the moving means including means for translating the carrier and means for rotating the carrier. The translating means and rotating means are preferably independently controlled, so that relative translation and rotation between the receiving and unloading positions may be varied. Preferably the translating means is linear. The receiving and unloading positions may be substantially at the same level, eg so that the path of the translating means is substantially horizontal. Preferably the rotating means is effective to rotate the carrier so that a container is rotated between said first and second orientations, eg through substantially 180° so that a container is upright at the receiving position and inverted at the unloading position.

In a preferred arrangement the translating means and the rotating means are reversible. In this case an unloaded container may be moved from the unloading position to a position intermediate the unloading and receiving positions, from which intermediate position transfer means may remove the unloaded container, eg in a direction transverse to the path of said translating means.

In a preferred arrangement the carrier means comprises a carnage slidable between the container receiving and unloading positions and a rotatable carrier mounted on the carriage.

The location of the unloading position may be determined by reference to the contents of the container, eg the lengths of the rod-like articles relative to a fixed datum position.

Means may be provided for advancing containers to the receiving position, eg on substantially horizontal conveyor bands. Particularly where the containers are advanced in abutment at least adjacent the receiving position, it is preferred that said translating means and rotating means are arranged such that initial movement of a container away from the receiving position includes both translational and rotational components: in this way a container may be removed from a flat surface containing an abutting line of containers upstream of the receiving position.

Preferably at least one of the translating and the rotating means includes means for moving the carrier to a preferred position following a stoppage. Such means may include means for interrogating at least one detector for the position of the carrier and subsequently moving the carrier to a reference position in a direction determined by the results of said interrogation.

According to another aspect of the invention apparatus for unloading containers of rod-like articles comprises means for delivering a container to an unloading position at which articles are unloaded though an open end of the container, and means for conveying unloaded articles away from the unloading position along a path, wherein the conveying means extends substantially across said open end at said unloading position except at said path. Preferably the extent of said path is substantially less than the extent of said open end, so that the conveying means extends across a substantial part of the width of said open end, eg with the path arranged centrally of said width. Preferably the container is so orientated at said unloading position (eg inverted) that said open end and said conveying means extend substantially horizontally with said conveying means immediately below said open end. In this way articles unloaded from the container, eg by release of a plate confining the articles in the container, have a very small distance to fall onto the conveying means. The level of articles already unloaded in said path may be controlled such that it is substantially the same as that of said conveying means. In a preferred arrangement the conveying means comprises endless band conveyor means, preferably opposed bands defining said path between their confronting ends.

By arranging that the conveying means is substantially immediately adjacent the open end of the container at the unloading position, the distance through which articles have to move at the unloading position from the container is both small and determinate, thereby eliminating or substantially reducing the disadvantages experienced in some prior art arrangements, namely that relatively complicated mechanisms are needed to maintain a surface of unloaded articles relatively flat to receive the next unloaded batch from a container and/or that there is a risk of unloaded articles becoming misaligned as they fall through an excessive distance onto that surface after unloading.

According to a further aspect of the invention apparatus for unloading containers of rod-like articles comprises means for delivering a container to an unloading position, and means for conveying unloaded articles away from the unloading position, wherein the conveying means is driven at a first relatively high speed during a first phase during which a first, major part of the contents of a container are unloaded and at a second, lower speed during a second phase during which the remainder of the contents of a container are unloaded. Preferably the transition between said first and second phases takes place dependent on a signal from detector means sensing the level of articles in or from an unloading container. Preferably the conveying means includes first conveyor means immediately adjacent the unloading container and second conveyor means downstream of said first conveyor means for conveying away a multi-layer stream of articles. The ratio of speeds of the first and second conveyor means preferably differs in said first and second phases: in one arrangement wherein the first conveyor means comprises confronting band conveyors and the second conveyor means comprises a further band conveyor the ratio of the speeds of the first conveyor means to the second conveyor means is 55% in the first phase and 105% in the second phase. It will be appreciated that these ratios will vary at least dependent on the height of any stream being conveyed by the second conveyor means.

Further detector means may be provided for stopping the conveying means substantially when the contents of a container have been unloaded. The further detector means may comprise a level detector arranged in the path of unloading articles immediately downstream of the unloading position.

The conveying means may convey a stream of articles to a variable capacity reservoir. Articles unloaded from a container may be received in the reservoir, which may have associated with it sensors for detecting the relative capacity of the reservoir and for controlling the conveying means in accordance with a signal derived from the sensor.

The various aspects of the present invention may be embodied in common apparatus.

BRIEF DESCRIPTION OF THE SEVERAL VIEWS OF THE DRAWINGS.

The invention will be further described, by way of example only, with reference to the accompanying diagrammatic drawings, in which:

FIG. 4 is a side view, similar to FIG. 3 but with some parts in different positions.

FIG. 7 is a detail plan view of part of the apparatus of FIG. 1.

DETAILED DESCRIPTION OF THE INVENTION

Figure 1:
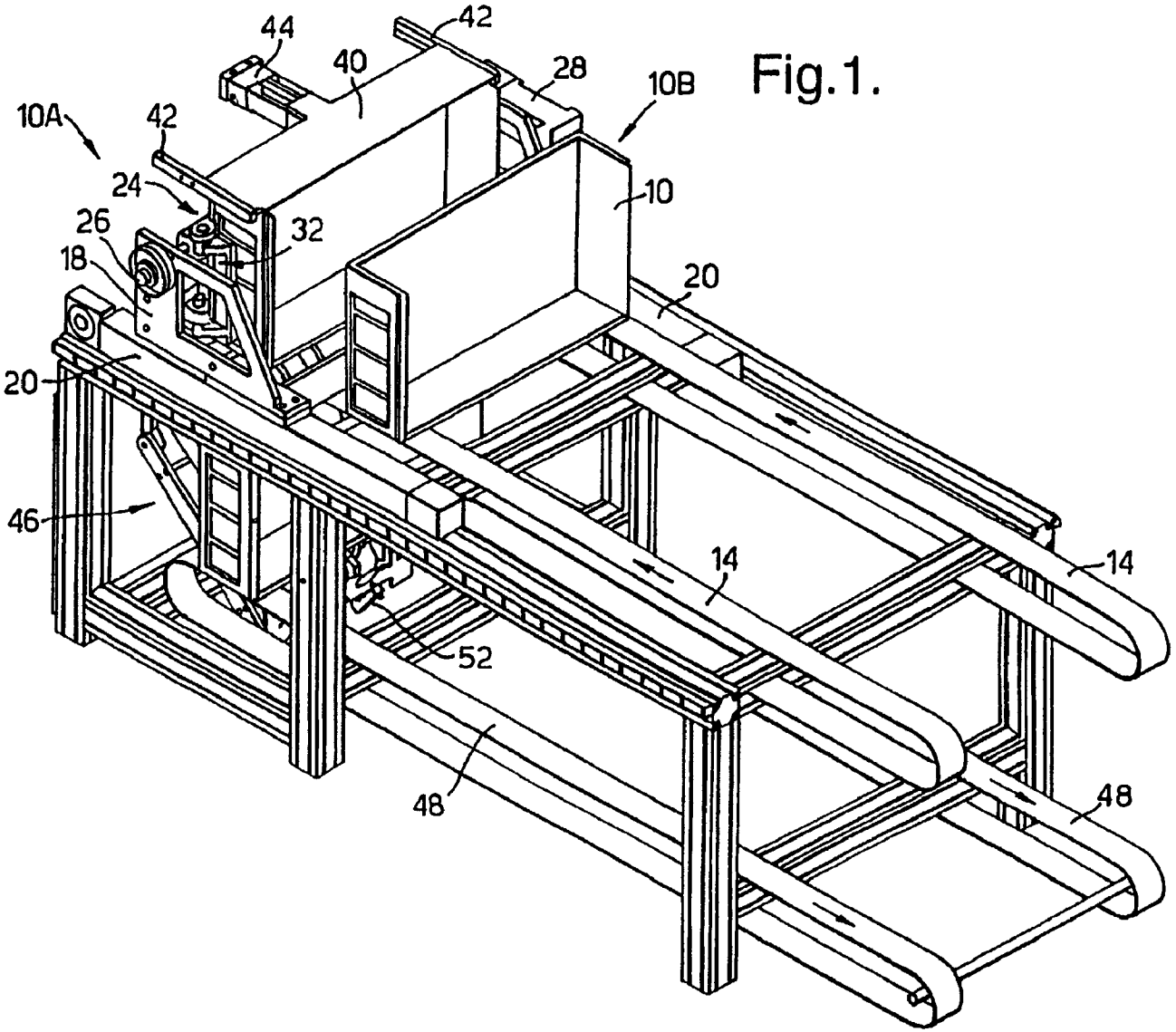
FIG. 1 is a perspective view of part of an apparatus for unloading trays of rod-like articles.
Figure 5:
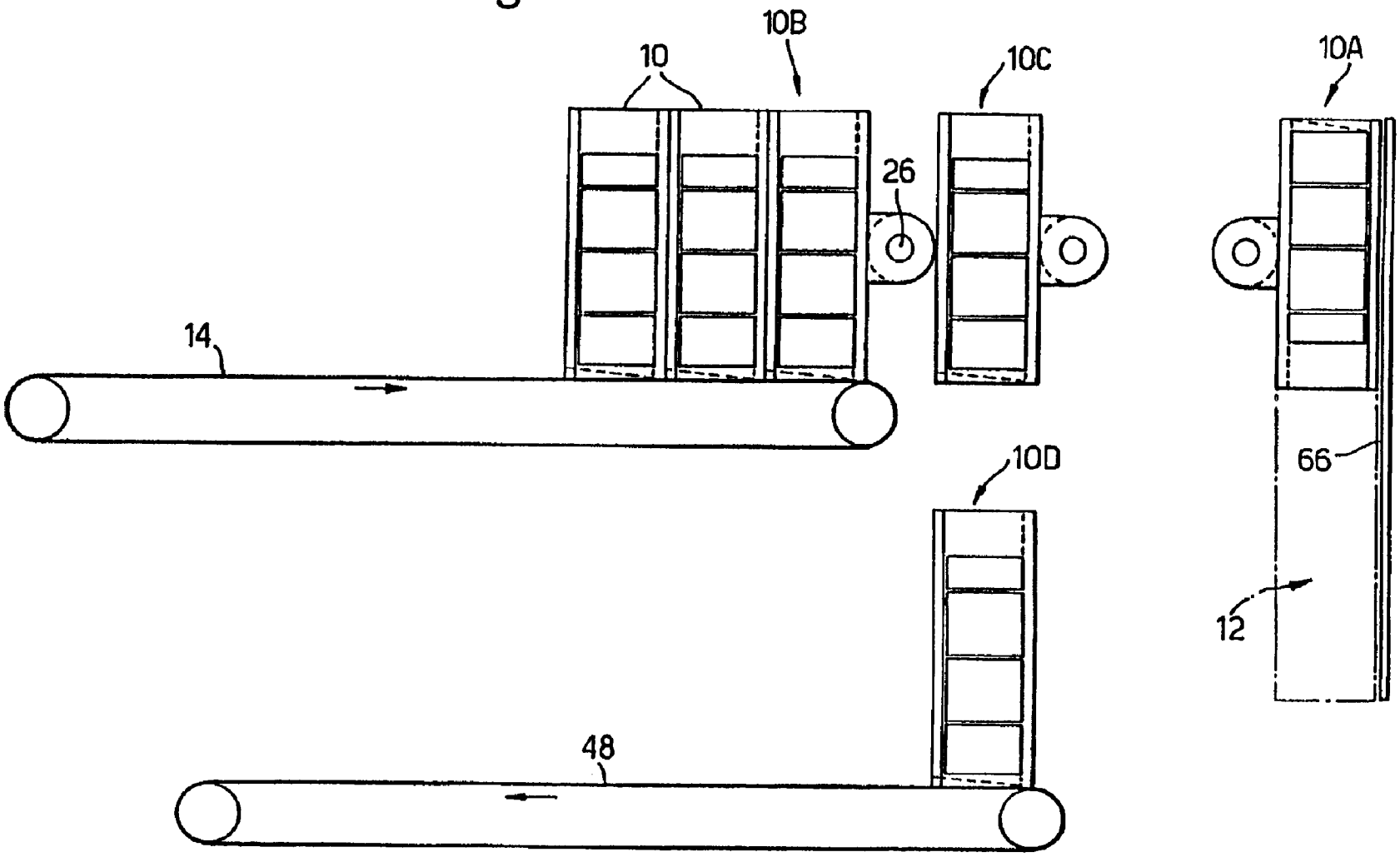
FIG. 5 is a schematic side view showing relative operative positions of the apparatus of FIG. 1.

FIG. 1 shows tray handling apparatus for delivering full trays 10 containing rod-like articles (not shown) to an unloading position 10A at which the trays are inverted to unload the articles to a conveyor system 12 (FIG. 6) in which the articles are conveyed away in a multi-layer stream of articles moving transverse to their lengths. Full trays 10 are delivered in an upright condition to a pick-up position 10B by an upper conveyor comprising laterally spaced bands 14. As shown in FIG. 5, trays 10 are normally disposed in abutment upstream of the tray in position 10B, which tray is maintained stationary by a pivoted latch 16 (FIG. 3), so that the bands 14 may continue to operate with an abutting line of stationary trays maintained up to the position 10B by the latch.

Figure 2:
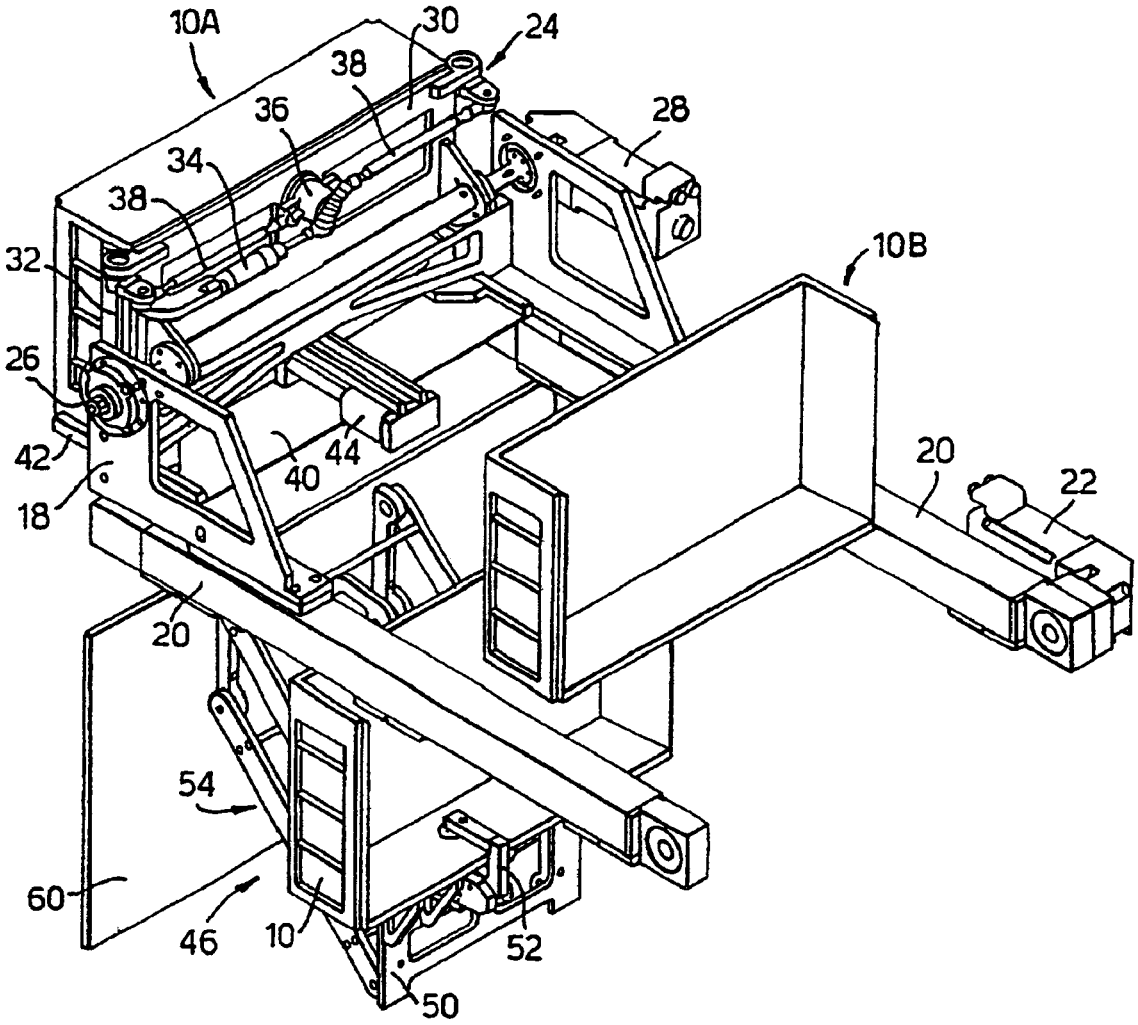
FIG. 2 is a perspective view of part of the apparatus of FIG. 1 with some parts in different operative positions.
Figure 8:
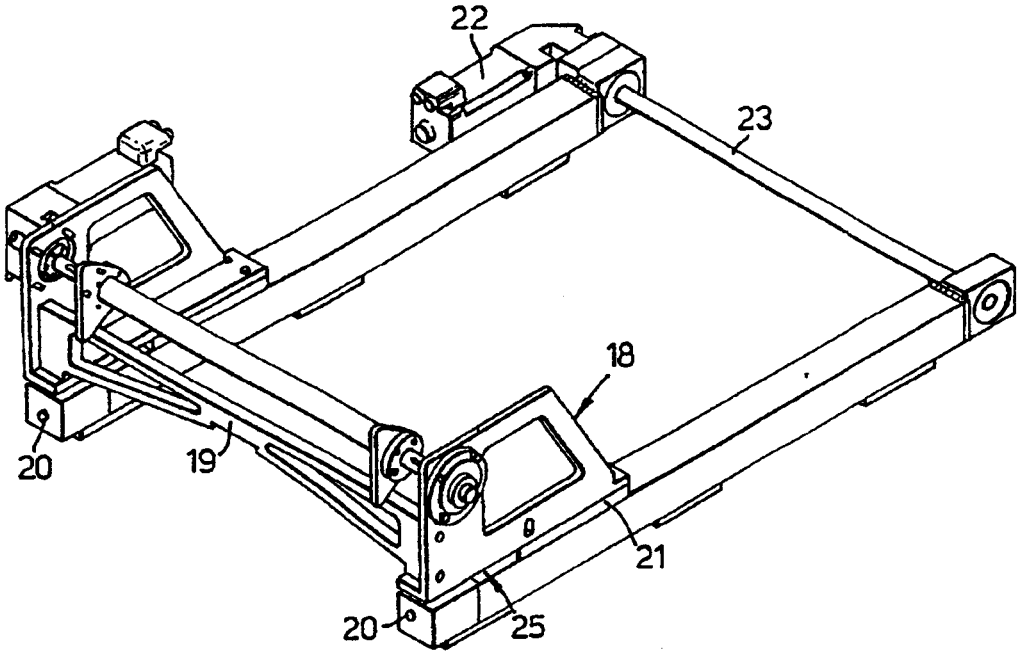
FIG. 8 is a perspective view of part of the apparatus of FIG. 1, showing details of a drive arrangement for a tray carriage.

Referring also to FIG. 8, a tray carriage 18 is supported by and slidably movable relative to a pair of slideways comprising linear actuators 20 which extend parallel to the bands 14 from positions laterally adjacent the pick-up position 10B. The carnage 18 comprises a frame 19 spanning and movable along the actuators 20 between positions adjacent the positions 10A and 10B under action of a servo drive motor 22 (FIG. 2). The frame 19 is attached to load plates 21 of the actuators 20 such that the carriage 18 is cantilevered beyond the travel limit 25 of the actuators when it is in the unloading position 10A. The motor 22 operates both actuators 20 through a common shaft 23.

Figure 3:
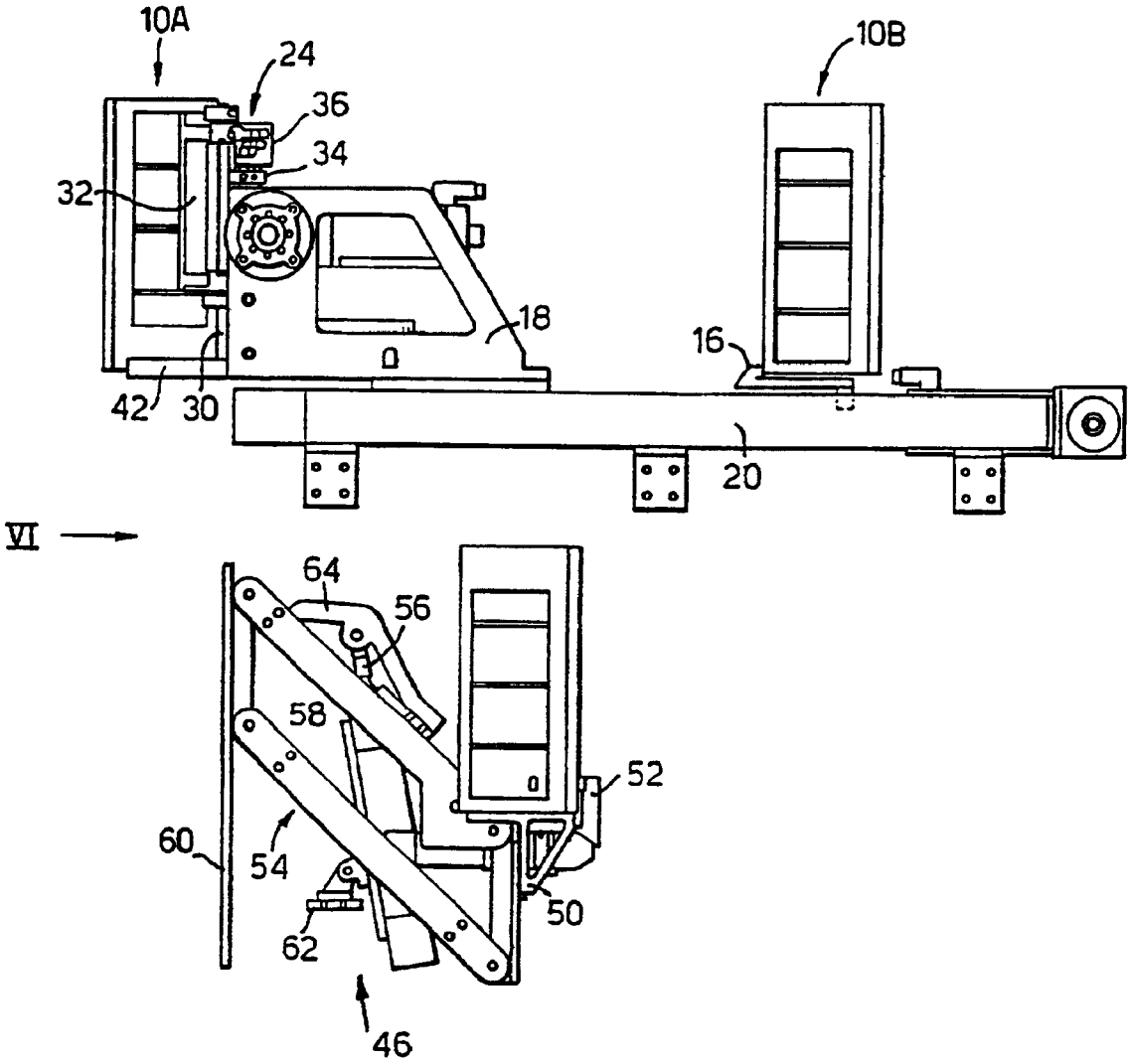
FIG. 3 is a side view of the apparatus as shown in FIG. 2.

A tray carrier 24 is pivotally supported at 26 on the carriage 18 and is pivotable, under action of a servo drive motor 28, through 180° between a position at which it can receive an upright tray 10 at the position 10B and a position at which it maintains an inverted tray at the unloading position 10A. Referring to FIGS. 1–3, the tray carrier 24 comprises a backplate 30, against which the rear face of a tray 10 is located when a tray is in place in the carrier, and a pair of pivoted side clamps 32 which operate under action of a pneumatic cylinder 34 operating through a rotor 36 and a pair of links 38, to clamp a tray in place on the carrier. The clamps 32 comprise an over centre mechanism and have the added capability of pulling a slightly misaligned tray into alignment on the carrier 24 as they clamp the tray. Also mounted on the carrier 24 is a release plate 40 which, in the position shown in FIG. 1, covers the open top of a tray received from the pick-up position 10B and is slidably supported by guides 42 so as to be movable, under action of a pneumatic cylinder 44, into a retracted position following insertion of a tray 10 at the unloading position 10A, as shown in FIG. 2.

As will be explained hereinafter, trays 10 which have been unloaded are returned by the tray carrier 24 to an upright condition in a position intermediate positions 10A and 10B. An empty tray transfer mechanism 46 receives each empty tray and deposits it on an empty tray conveyor comprising laterally spaced bands 48 located below the bands 14. The mechanism 46 comprises a tray support 50, on which the base of the tray 10 is received, and a clamp 52 which is pivoted to the support about a horizontal axis and movable between a position clear of the support to allow reception of a tray from above and the position shown in the drawings, in which it engages the upper surface of the base of the tray to locate it on the support. The support 50 is mounted on a four bar (parallel bar) linkage 54 so as to be maintained in the same orientation as it is moved between a tray receiving position (above the position shown in FIG. 4) and a tray delivering position, as shown in FIGS. 1–3, in which the empty tray is deposited on the bands 48 which subsequently convey the tray away. The linkage 54 is pivotally connected to the support 50 and to a fixed backplate 60, and is operated by an actuating rod 56 and a linear actuator with braking capability in the form of an Acme lead screw 58, itself pivotally connected to a fixed part 62 of the apparatus. The connection between the actuating rod 56 and the linkage 54 is by way of a pivotal mounting in a bracket 64 connected to the linkage: in FIG. 4 the end of the rod 56 is shown separated from the bracket 64 but in operative condition these would be connected, as shown in FIG. 3.

In operation, trays 10 filled with rod-like articles are advanced by the bands 14 in the direction indicated in FIG. 1. A leading tray 10 is stopped at the position 10B, engaged by the latch 16 (FIG. 3). Normally trays 10 accumulate in line abutment on the bands 14 behind a tray in position 10B, as indicated in FIG. 5.

The carriage 18 is advanced towards the position 10B with the carrier 24 in an upright condition and the tray clamps 32 in retracted positions. A leading part of the carriage 18 has a part (eg an inclined face, not shown)

adapted to cooperate with the inclined leading face of the latch 16 so as to pivotally displace it when the carriage reaches the position 10B and allow the leading full tray 10 to be engaged by the carrier 24. At this time the clamps 32 are operated to grip the tray 10. The release plate 40 may be moved to an extended position to cover the open top of the tray at any time after a tray has emptied and before the next full tray begins to be turned over: one currently preferred timing is to extend the plate when the carriage is in position 10C (FIG. 5) just prior to delivery of an empty tray to the empty tray transfer mechanism 46.

After a tray 10 has been located on the carrier 24 by the clamps 32, the motors 22 and 28 operate substantially simultaneously so that initial movement of the tray from the position 10B includes linear and rotational components. This facilitates removal of a tray from the position 10B when there is an immediately abutting following tray on the bands 14 (by providing a compound movement which draws the bottom trailing corner of the tray upwards and forwards). After a leading tray has been withdrawn from the position 10B the latch 16, released from its displacement by the carriage 18, returns under action of a counterweight to its previous position so that the next tray advanced by the bands 14 is stopped at position 10B.

The carriage 18 moves away from the position 10B and the carrier 24 is rotated through 180° to invert the tray 10, such movement and rotation being complete at the unloading position 10A. The motors 22 and 28 are independently controlled: hence the relative rates (including acceleration and deceleration) at which the carriage 18 may be moved and the carrier 24 rotated are independently controllable. In this way, it is possible to adjust the positions of the carriage 18 at which the carrier 24 assumes given rotational positions: although initiating linear and rotational movement at the same time at the position 10B is preferred, linear and rotational movements may start at different times and proceed continuously or intermittently at different rates, eg the start of rotational movement could be delayed until some movement of the carriage 24 has occurred or rotational movement of the carrier 24 may be completed in stages so that after an initial movement the carrier is maintained in a fixed inclined position while the carriage moves for some distance. The relative rates and positions at which linear and rotational movements take place may be varied in accordance with parameters associated with the articles contained in the trays: for example, cigarettes are more delicate than filter rods and so may not tolerate such rapid inversion of a tray. Another possibility is that the relative rates of linear and rotational movement may be varied in accordance with the lengths of the articles contained in the trays.

At the unloading position 10A the release plate 40 is withdrawn, allowing the articles contained in the tray to descend to the conveyor system 12. The apparatus includes a transparent stationary front plate 66 (FIG. 5) at the unloading position 10A and extending also at the front of the conveyor system 12, to confine the articles if necessary.

When unloading of the contents of a tray at the unloading position 10A is complete, the carriage 18 is retracted and the carrier 24 rotated to an upright condition during movement to the position 10C (FIG. 5), intermediate the positions 10A and 10B. As before, relative rotational and linear movements may be adjustable: as the tray is empty during this phase of movement, no consideration as to imposition of excessive forces on delicate articles is necessary.

At the position 10C the empty tray 10 is delivered to the empty tray transfer mechanism 46. The linkage 54 is raised so that the support 50 abuts the bottom of the tray 10 and the clamp 52 is pivoted upwards and subsequently down onto the upper face of the bottom of the tray to clamp it to the support. The pivoted clamps 32 on the carrier 24 are retracted to release the tray, which is subsequently moved down on the support by the linkage 54 until it rests on the upstream ends of the bands 48 in position 10D (FIG. 5). The clamp 52 is retracted just prior to placement of the empty tray 10 on the bands 48 so that the empty tray can be conveyed away from position 10D by the bands. During the initial part of movement of the empty tray transfer mechanism 46, as soon as the tray is clear of the carrier 24, the carriage 18 is advanced from position 10C to position 10B to pick up the next fill tray 10 and commence the next cycle.

It will be apparent that the position of the carriage 18 is critical to correct operation of the unloading apparatus. Thus, after any stoppage, eg disconnection from an electrical supply, it is arranged that the carriage 18 is moved by the motor 22 to a preferred definite position from which subsequent movements are made as determined by the control system. As shown in FIG. 7, in order to achieve this the carriage 18 carries with it a sensor bar 94 which moves along a path parallel to and adjacent one of the actuators 20 as the carriage moves. The sensor bar 94 is stepped so as to comprise a first, longer portion 96 and a second, shorter portion 98. Fixed to the (stationary) frame of the actuator 20 and just below the path of the bar 94 are three sensors 100, 102, 104, each capable of detecting when the bar 94 is located above the sensor.

The carriage 18 is movable between end positions 18A and 18B as shown in FIG. 7. Position 18A is beyond the tray unloading position 10A and position 18B is beyond the full tray pick-up position 10B. Sensor 100 is located so that it is just covered by the bar 94 at position 18B, as indicated in FIG. 7. Sensor 104 is located so that it is just covered by the shorter portion 98 of the bar 94 at position 18A. At an intermediate position 18E, approximately halfway between positions 18A and 18B, the sensor 102 is just covered by the end of the longer portion 96 of the bar 94 when the carriage 18 is in position 18B; in other words, the length of the portion 96 just exceeds the distance between sensors 100 and 102.

In operation, after any stoppage sensor 102 is used to determine if the carriage 18 is to the left (as viewed in FIG. 7) of position 18E (the sensor is covered by the portion 96) or if it is to the right (the sensor is uncovered). Subsequently, in either case the carriage 18 is moved towards position 18E, and the switching transition (between sensor 102 being covered and uncovered or vice versa) used to determine when that position is reached. At that position the movement is stopped and the absolute position of the carriage 18 is reestablished, at the known reference position 18E. The carriage 18 can then perform a precisely controlled movement to any position along its path.

If the carriage 18 reaches position 18A or 18B, each of which is beyond the respective end of the normal operating range of movement of the carriage, sensor 100 or 104 detects this and signals a fault.

It will be appreciated that position of the carrier 24 is similarly critical to correct operation of the apparatus. A precisely analogous control system is provided to move the carriage 24 into a reference rotational position, the only difference being that the parts corresponding to the sensor bar 94 and the corresponding sensors are arranged on an arcuate path about the axis 26.

In the tray unloading position 10A the position at which the carriage 18 stops may be adjustable: in this way it is possible, if required to operate the apparatus so that the unloading position is determined by reference to the articles contained in the tray, eg so that the free ends of the articles are located a fixed distance from the plate 66, instead of by reference to parts of the tray or apparatus itself. The position at which the carriage 18 stops at the pick-up position 10B may be similarly adjustable: in particular this may need to be varied if for instance a different style of tray 10 were used necessitating a different tray clamping mechanism.

Figure 6:
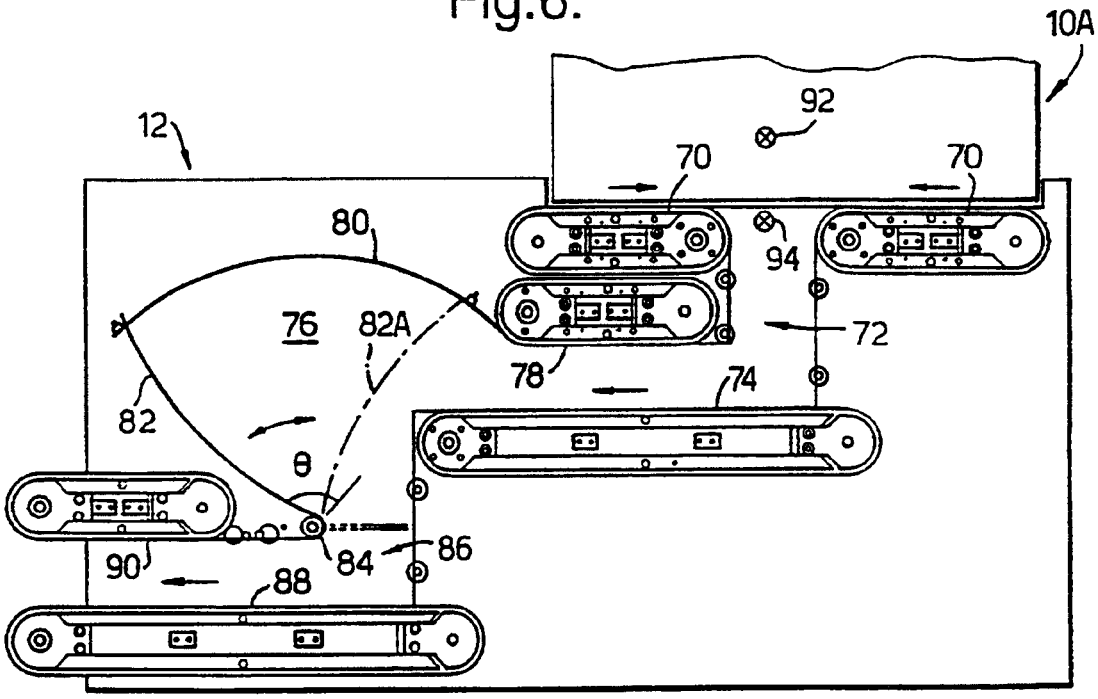
FIG. 6 is a front view of the apparatus, in the direction of arrow VI in FIG. 3.

Referring to FIG. 6, the conveyor system 12 downstream of the unloading position 10A comprises confronting endless bands 70 having horizontal upper runs arranged substantially immediately below the unloading position 10A. Extending from the opening between the ends of the bands 70 is a vertical channel 72 leading to a further conveyor band 74 extending horizontally towards a variable capacity reservoir 76. An upper band 78 is arranged above the band 74 along part of its length.

The reservoir 76 comprises an arcuate top plate 80 and an arcuate side plate 82 arranged opposite the downstream end of the conveyor band 74 and pivotable about an axis 84 so as to be movable between the position shown in full lines in FIG. 6 (in which the reservoir 76 is substantially fill) and the position 82A shown in dotted lines (in which the reservoir is substantially at its minimum capacity). At its lower end the reservoir 76 has an outlet 86 leading downwards onto a horizontal conveyor band 88. A top band 90 is arranged above the downstream end of conveyor band 88.

Rod-like articles unloading from a tray at position 10A are urged by conveyor bands 70 into channel 72. A substantially continuous multi-layer stream of articles is received in the channel 72 and delivered by way of bands 74 and 78 to the variable capacity reservoir 76. The pivoted plate 82 is lightly counterweighted so that it is urged in a clockwise direction as shown in FIG. 6 to maintain slight pressure on the articles in the reservoir so as to confine the articles and prevent the occurrence of voids. Articles are withdrawn from the outlet 86 of the reservoir by the bands 88 and 90. A stream of articles delivered by the bands 88, 90 may be conveyed to further processing apparatus. For example, where the articles are cigarettes, the further processing apparatus may be a cigarette packing machine; where the articles are filter rods, the apparatus may be a distributor for pneumatically conveying the filter rods to a filter cigarette assembling machine.

The bands 70, 74 and 78 are controlled separately. The bands 70 run at the same speed as each other, as do the bands 74, 78 and 88, 90 respectively. In various operative conditions the speeds of the bands 70, 74 and 88 depend on the level of fill (volume) of the reservoir 76 and on the status of upper and lower article level detectors 92, 94 located respectively at and adjacent the unloading position 10A. Each of the detectors 92, 94 may comprise opto-electronic means which senses the presence of adjacent articles, eg by sensing interruption of a beam of radiation: such means are well known in the cigarette industry. The upper detector 92 is positioned immediately above the channel 72 at a height corresponding to a level reached by the articles when a tray at unloading position 10A is about 80% unloaded. The lower detector 94 is positioned at the upper end of the channel 72 just below the level of the bands 70.

While the majority of the contents of a tray at the unloading position 10A are being delivered to the conveyor system 12 the detector 92 is covered, ie detects articles. In this situation, the bands 70 are run at a speed which bears a fixed relationship to the speed for the time being of the band 74. A preferred ratio is that the bands 70 have a speed which is set at about 55% of the speed of the band 74. If the reservoir or volume value is less than a predetermined high value (eg corresponding to 85% of maximum capacity) the band 74 is run at a fixed high speed so as to unload the tray rapidly. With filter rods, for example, this speed may be as high as that corresponding to a flow rate of 48,000 rods per minute (with a stream height on conveyor 74 of about 120 mm and rod diameters of about 8 mm). If the reservoir volume value exceeds the predetermined value the speed of band 74 is reduced to approximately that of band 88 (which is itself typically determined by downstream apparatus). In this condition the speed of band 74 may be progressively controlled according to reservoir capacity. For example, between 85% and 95% reservoir capacity the speed of the band 74 may be progressively reduced, eg from a value corresponding to 5% in excess of the speed of band 88 to a value corresponding to 5% less than that of the band 88. If the reservoir volume value exceeds 95% capacity the band 74 will be stopped. During all of this time (while the detector 92 detects articles), the speed of bands 70 is 55% of that of the band 74 for the time being.

As soon as detector 92 is uncovered, indicating that the tray at unloading position 10A has typically unloaded 80% of its contents, the speed of band 74 is fixed (eg at a rate corresponding to 12,000 rods per minute for filter rods as mentioned hereinbefore). In this condition, ie with detector 92 uncovered, bands 70 run slightly faster than band 74, eg at 105% of the speed of band 74. Once this final stage of unloading of a tray at the unloading position 10A has started, bands 70 and 74 run at these speeds until detector 94 is uncovered, irrespective of the capacity of reservoir 76. When detector 94 is uncovered the band 74 is stopped and the bands 70 run for a predetermined short additional time (eg 0.5 seconds) before stopping also.

In a preferred mode of operation the speed of band 74 is controlled according to the angular position (θ, FIG. 5) of the pivoted plate 82. Thus, where θ is in the following ranges the speed of band 74 is as indicated:

0°–17° Stopped;

18°–69° High speed (eg corresponding to 48,000 cpm);

70°–79° Controlled speed based on speed of band 88 (eg progressively reducing from above to below speed of band 88);

80°–90° Stopped (unless detector 92 is uncovered); Low speed (eg corresponding to 12,000 cpm) if detector 92 is uncovered and detector 94 covered;

90° Stopped—reservoir 76 is in a jam condition (fault).

Under normal running conditions the reservoir 76 is never allowed to fill such that the angle θ exceeds 80°. This provides enough remaining capacity (with θ between 80° and 90°) that if the downstream demand for articles stops just as detector 92 is uncovered (so that band 88 is stopped) there is enough remaining room in the reservoir 76 to accept all remaining articles unloaded from a tray 10 in the unloading position 10A in a controlled manner.

After a tray has been completely unloaded the empty tray is removed and a new full tray moved into position 10A as hereinbefore described. On retraction of the release plate 40, articles in the new full tray have a minimum distance to fall (eg a few millimeters maximum) onto the bands 70 and the articles at the top of the channel 72. During the tray change the bands 70 and 74 remain stationary so that the level of articles in the channel 72 remains approximately the same as that of the bands 70.

What is claimed is:

1. Apparatus for unloading containers for rod-like articles, comprising:

a carrier for receiving a full container in a receiving position in a first orientation; and carrier moving means for moving the carrier to an unloading position at which the carrier is in a second orientation, the carrier moving means including means for translating the carrier and means for rotating the carrier, wherein the translating means and rotating means are independently controlled and are adapted to operation concurrently, and including means for interrogating at least one detector for the position of the carrier and for subsequently moving said carrier to a reference position in a direction determined by the results of said interrogation;

wherein at least one of the translating means and the rotating means includes means for moving the carrier to a preferred position following a stoppage of said apparatus.

2. Apparatus as claimed in claim 1, wherein the translating means moves the carrier along a substantially linear path.

3. Apparatus as claimed in claim 1, wherein the receiving and unloading positions are substantially at the same level.

4. Apparatus as claimed in claim 1, wherein the rotating means is effective to rotate the carrier so that a container is rotated between said first and second orientations.

5. Apparatus as claimed in claim 1, wherein the translating means and rotating means are each reversible.

6. Apparatus as claimed in claim 5, further including transfer means for receiving an unloaded container from said carrier at a position intermediate said unloading position and said receiving position.

7. Apparatus as claimed in claim 1, wherein the carrier comprises a carriage slidable between said receiving and unloading positions and a rotatable carrier mounted on the carriage.

8. Apparatus as claimed in claim 1, wherein the position at which the translating means locates the carrier at the unloading position is determined by reference to a dimension of the container or its contents.

9. Apparatus as claimed in claim 1, wherein the translating means and rotating means are arranged such that initial movement of the container away from the receiving position includes both translational and rotational components.

10. Apparatus as claimed in claim 1, said carrier moving means being configured such that said articles are unloaded through an open end of said container, and further comprising means for conveying unloaded articles away from the unloading position along a path, wherein the conveying means extend substantially across said open end at said unloading position except at said path.

11. Apparatus as claimed in claim 10, wherein the extent of said path at said unloading position is substantially less than the extent of said pen end, so that the conveying means extends across a substantial part of the width of said open end.

12. Apparatus as claimed in claim 10 or claim 11, wherein the container is so orientated at said unloading position that said open end and said conveying means extend substantially horizontally with said conveying means immediately below said open end.

13. Apparatus as claimed in claim 10 or claim 11, including means for controlling articles in the path such that articles already unloaded in the path may be maintained at a level which is substantially the same as that of the conveying means.

14. Apparatus as claimed in claim 10 or claim 11, wherein the conveying means comprises endless band conveyor means.

15. Apparatus as claimed in claim 14, wherein the endless band conveyor means comprises opposed bands defining said path between confronting ends.

16. Apparatus for unloading containers of rod-like articles, comprising means for delivering a container to an unloading position, and means for conveying unloaded articles away from the unloading position, wherein the conveying means is driven at a first relatively high speed during a first phase during which a first, major part of the contents of a container is unloaded and at a second, lower speed during a second phase during which the remainder of the contents of a container is unloaded.

17. Apparatus as claimed in claim 16, wherein the transition between said first and second phases takes place dependent on a signal from detector means sensing the presence of adjacent articles in or from an unloading container.

18. Apparatus as claimed in claim 17, wherein the conveying means includes first conveyor means immediately adjacent the unloading container and second conveyor means downstream of said first conveyor means for conveying away a multi-layer stream of articles.

19. Apparatus as claimed in claim 18, wherein the ratio of speeds of the first and second conveyor means differs in said first and second phases.

20. Apparatus as claimed in claim 16 or claim 17, wherein said first speed is variable and said second speed is fixed.

21. Apparatus as claimed in claim 20, wherein said first speed is determined in accordance with signals derived from receiving means downstream of said conveying means.

22. Apparatus as claimed in claim 16 or claim 17, including further detector means for stopping the conveying means substantially when the contents of the container have been unloaded.

23. Apparatus as claimed in claim 22, wherein the further detector means comprises a level detector arranged in the path of unloading articles immediately downstream of the unloading position.

24. Apparatus as claimed in claim 16 or claim 17, including a variable capacity reservoir for receiving articles from the conveying means, including at least one sensor for detecting the relative capacity of the reservoir, and further including means for controlling the conveying means in accordance with signals derived from the sensor.

25. Apparatus for unloading containers for rod-like articles, comprising:

a carrier for receiving a full container in a receiving position in a first orientation; and carrier moving means for moving the carrier to an unloading position at which the carrier is in a second orientation, the carrier moving means including means for translating the carrier and means for rotating the carrier, wherein the translating means and rotating means are independently controlled and are adapted to operate concurrently, said carrier moving means being configured such that said articles are unloaded through an open end of said container; and conveying means for conveying unloaded articles away from the unloading position along a path, wherein the conveying means extend substantially across said open end at said unloading position except at said path, wherein the conveying means is driven at a first relatively high speed during a first phase during which a first, major part of the contents of the container is unloaded and at a second, lower speed during a second phase during which the remainder of the contents of the container is unloaded.

26. Apparatus for unloading open-top containers of rod-like articles, said apparatus composing:

a plurality of slideways comprising linear actuators;

a tray carriage supported on said slideways, such that said tray carriage is capable of sliding linearly relative to said slideways between a pick-up position and an unloading position;

a first servo drive motor adapted for driving said linear actuators;

a tray carrier which is adapted to receive an open-top container of rod-like articles, said tray carrier being supported on said tray carriage, and being pivotable relative to said tray carriage through about 180° between a first position in which it can receive an upright container at said pick-up position, and a second position in which it maintains an inverted carrier at said unloading position, said tray carrier comprising a plurality of clamps which are selectively operable for clamping a container in place on the tray carrier, and a retractable release plate that can be arranged for covering an open top of a container on the tray carrier;

a second servo drive motor for rotating said tray carrier between said first and second positions;

wherein said first and second servo drive motors are adapted to provide simultaneous, independent control of the linear movement of the tray carriage and rotational movement of the tray carrier, and to allow the relative rates and positions at which said linear and rotational movements take place to be varied in accordance with parameters associated with the articles in the containers.

27. Apparatus as claimed in claim 26, wherein said first servo drive motor is reversible.

28. Apparatus as claimed in claim 26, wherein said second servo drive motor is reversible.

29. Apparatus as claimed in claim 26,further comprising an empty tray conveyor for removing empty trays, and an empty tray transfer mechanism that is adapted to receive an empty tray from the tray carrier at a position intermediate said pick-up position and said unloading position, and deposit said empty tray on said empty tray conveyor.

* * * * *